US008712769B2

(12) United States Patent
Song et al.

(10) Patent No.: US 8,712,769 B2
(45) Date of Patent: Apr. 29, 2014

(54) APPARATUS AND METHOD FOR NOISE REMOVAL BY SPECTRAL SMOOTHING

(75) Inventors: Jianming Song, Barrington, IL (US); David Barron, Scottsdale, AZ (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 205 days.

(21) Appl. No.: 13/330,235

(22) Filed: Dec. 19, 2011

(65) Prior Publication Data

US 2013/0158989 A1 Jun. 20, 2013

(51) Int. Cl.
*G10L 21/0232* (2013.01)

(52) U.S. Cl.
CPC ..... *G10L 21/0232* (2013.01)
USPC ..... 704/226

(58) Field of Classification Search
CPC ..... G10L 21/0232
USPC ..... 704/226
See application file for complete search history.

(56) References Cited

U.S. PATENT DOCUMENTS 6,549,586 B2 * 4/2003 Gustafsson et al. ..... 375/285
6,717,991 B1 * 4/2004 Gustafsson et al. ..... 375/285
2005/0060142 A1 3/2005 Visser
2009/0106021 A1 4/2009 Zurek et al.
2009/0164212 A1 6/2009 Chan
2011/0099007 A1 4/2011 Zhang

FOREIGN PATENT DOCUMENTS

WO 9718647 5/1997

OTHER PUBLICATIONS

Osamu Hoshuyama and Akihiko Sugiyama "Robust Adaptive Beam Forming" Microphone Arrays: Speech Processing Techniques and Applications, 2001, ISBN: 30540-41953-5, NEC Media Research Labs, Kawasaki, Japan.
International Search Report and Written Opinion for PCT Application No. PCT/US2012/070010, mailed on Jun. 28, 2013. 10 pages.
Tashev, Ivan J. Sound Capture and Processing: Practical Approaches, Microsoft Research, USA, John Wiley & Sons Ltd., 2009.

* cited by examiner

*Primary Examiner* — Susan McFadden

(57) ABSTRACT

A continuous stream of noise is created from a plurality of input signals. A smoothing spectrum estimate is continuously calculated from the continuous stream of noise. Noise is responsively removed from a selected one of the plurality of input signals using the smoothing spectrum estimate. The removal of the noise from the selected input signal is performed substantially synchronously and in time alignment with the creating of the continuous stream of noise and the calculating of the smoothing spectrum estimate.

16 Claims, 4 Drawing Sheets

APPARATUS AND METHOD FOR NOISE REMOVAL BY SPECTRAL SMOOTHING

FIELD OF THE INVENTION

The invention relates generally to approaches for noise removal in electronic circuits.

BACKGROUND OF THE INVENTION

Vehicles are often equipped with various types of devices that produce and receive sound energy. For example, various hands-free systems are used by vehicle occupants to control various vehicular functions through a user speaking commands into a microphone, and the commands being recognized and executed by one or more control modules at the vehicles. The users in the vehicles may also use cellular phones or other types of sound producing or receiving devices.

Noise removal or suppression is important for clear mobile voice communications or accurate automatic speech recognition. However, effectively removing ambient noise without introducing distortion to speech has long been a difficult challenge. Over the past few decades, numerous noise suppression (NS) algorithms have been developed, particularly in the category of single channel noise suppressors. Some of these algorithms are widely used in mobile phones, Bluetooth headsets, hearing aids and hands-free car kits for the purpose of enhancing speech in noisy environment.

These algorithms are sometimes capable of suppressing stationary noise contaminated to speech (e.g., with 15 dB SNR improvement under a static car engine noise condition). However, the performance degrades significantly if the ambient noise changes dynamically over time (e.g., 4 dB SNR improvement in babble noise conditions). One reason for this degradation is that most voice activity detection (VAD) approaches used in these previous algorithms have difficulties in separating speech from non-stationary noise (e.g. multi-talker babble noise). Another reason for the degradation is that the estimated noise and the noise presence are not time aligned. More specifically, noise suppression algorithms typically estimate noise when speech is absent, but freezes noise estimation when speech is present. As a consequence, the noise subtraction/attenuation during speech periods typically depend on an "out-of-date" noise estimates.

Although this asynchronous noise estimation/utilization process is sometimes acceptable when the ambient noise is stationary, it becomes over-simplistic and not suitable in canceling non-stationary noises, such as transient traffic noise, or babble noise. In these later cases, outdated information is used and noise removal is not effective or acceptable. The absence of effective noise removal produces audio qualities that are unacceptable for many users.

BRIEF DESCRIPTION OF THE DRAWINGS

The present invention is illustrated, by way of example and not limitation, in the accompanying figures, in which like reference numerals indicate similar elements, and in which.

Figure 1:
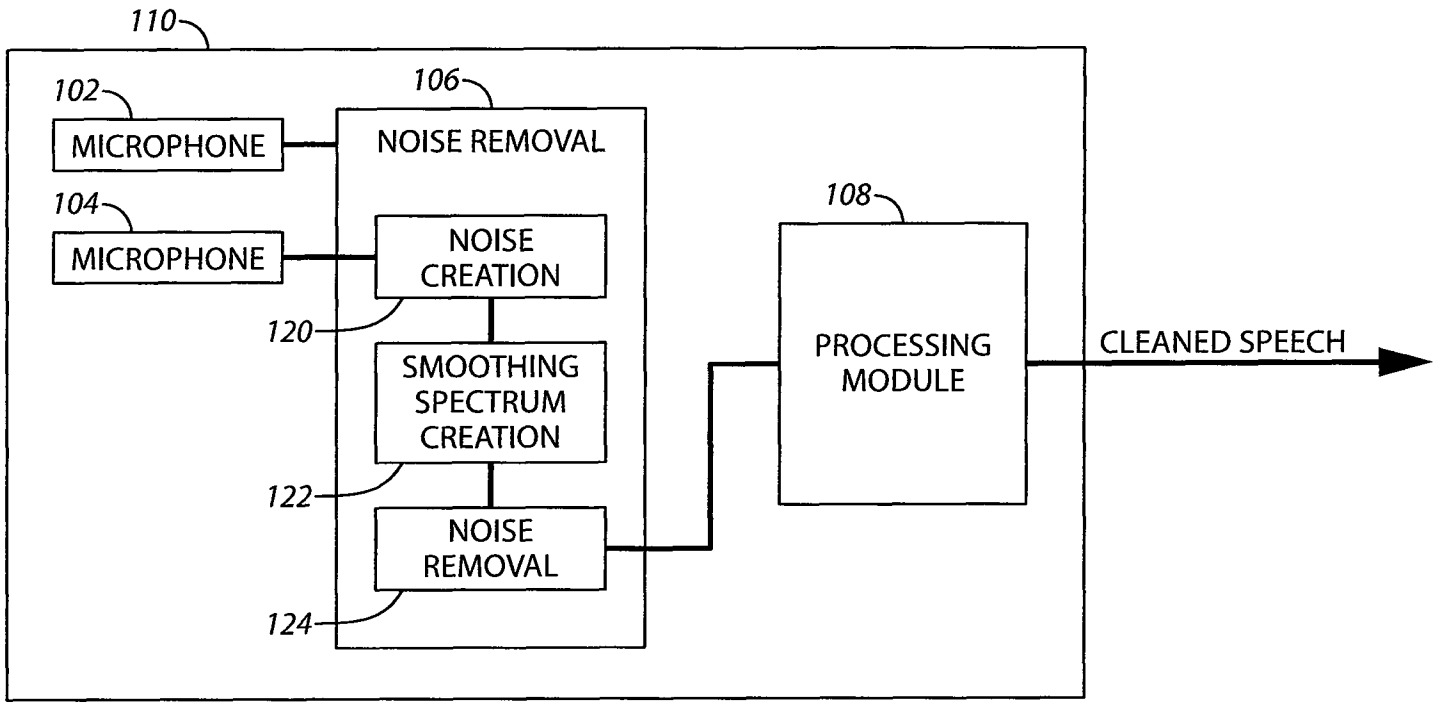
FIG. 1 comprises a block diagram of a noise suppression system according to various embodiments of the present invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION OF THE PREFERRED EMBODIMENTS

In the approaches described herein noise is estimated continuously or substantially continuously (e.g. during speech). The noise estimate is removed from the signal of interest (that includes both speech and noise) and the noise removal can be made more effectively than previous approaches, for instance, since the noise cancellation and noise estimate are synchronous with each other (i.e., there is no substantial delay between these events).

In many of the approaches described herein, a multi-source signal separation algorithm is used to achieve more effective noise suppression. The present approaches remove utilizing voice activity detection (VAD) and conventional noise estimates typically utilized in previous approaches. In this respect, a smoothing factor is calculated and applied to the noise estimate. In some aspects, the smoothing factor is based on the discrepancy between a long term and a short term noise estimates. In some examples, the continuous noise estimate is incorporated into a gain function calculation for noise suppression.

More specifically and in many of these embodiments, a continuous stream of noise is created from a plurality of input signals. A smoothing spectrum estimate is continuously calculated from the continuous stream of noise. Noise is responsively removed from a selected one of the plurality of input signals using the smoothing spectrum estimate. The removal of the noise from the selected input signal is performed substantially synchronously and in time alignment with the creating of the continuous stream of noise and the calculating of the smoothing spectrum estimate.

In other aspects, the noise removal utilizes one or more of a gain function, a noise subtraction approach, or a Weiner filter. Other examples are possible. Calculating the smoothing spectrum estimate may include calculating a difference in spectral deviation between a long term noise estimate and a short term noise estimate.

In other aspects, the plurality of input signals comprises a plurality of microphone signals. In yet other aspects, the plurality of microphone signals are formed from a plurality of microphones disposed at a device, and the device may be a mobile phone, a hands-free vehicular application, or a hearing aid. The microphones may be deployed at other types of devices as well. In still other aspects, the plurality of input signals includes a first signal from a primary microphone and a second signal from a secondary microphone. In some examples, creating a continuous stream of noise includes cancelling a speech component from the secondary microphone signal using the first signal as a reference to leave a continuous noise signal.

In others of these embodiments a first signal and a second signal are received. A continuous stream of noise is created based upon the first signal and the second signal. A smoothing spectrum estimate is continuously calculated using the continuous stream of noise. Noise is responsively removed from the first signal using the smoothing spectrum estimate. The removal of the noise is performed substantially synchronously and in time alignment with creating the continuous stream of noise and calculating the smoothing spectrum estimate.

In still others of these embodiments, a system for suppressing noise from a signal includes a noise creation module, a smoothing spectrum creation module, and a noise removal module. The noise creation module is configured to create a continuous stream of noise from a plurality of input signals. The smoothing spectrum creation module is coupled to the noise creation module and is configured to continuously calculate a smoothing spectrum estimate from the continuous stream of noise. The noise removal module is coupled to the smoothing spectrum module and is configured to remove noise from a selected one of the plurality of input signals using the smoothing spectrum estimate. The noise removal module removes noise from the selected one of the plurality of input signals substantially synchronously and in time alignment with the noise creation module creating the continuous stream of noise.

In some aspects, the smoothing factor creation module is configured to calculate the smoothing spectrum estimate by determining a difference in spectral deviation between a long term noise estimate and a short term noise estimate. In other aspects, the application of the smoothing spectrum estimate is effective to suppress noise in the microphone signal. In some other aspects, the plurality of input signals comprises a first signal from a primary microphone and a second signal from a secondary microphone. In yet other aspects, the noise creation module is configured to create the continuous stream of noise by cancelling a speech component from the secondary microphone signal using the first signal as a reference to leave a continuous noise signal.

Referring now to FIG. 1, a system includes a first microphone 102, a second microphone 104, a noise suppression module 106, and a processing module 108. The first microphone 102 and the second microphone 104 are configured to receive voice signals and may be disposed anywhere, for example, within or at a vehicle 108. However, it will appreciated that the microphones 102 and 104 and noise suppression module 106 may be deployed in other locations such as at a hearing aid, mobile phone, or Bluetooth handset. Other examples are possible.

The noise reduction module 106 as described elsewhere herein is configured to remove noise from the signals. In one aspect, the approach used combines a multi-sensor module followed by single channel noise suppression.

More specifically, the noise suppression module 106 includes a noise creation module 120, a smoothing spectrum creation module 122, and a noise removal module 124. The noise creation module 122 is configured to create a continuous stream of noise from a plurality of input signals (the microphone signals). The smoothing spectrum creation module 122 is coupled to the noise creation module 120 and is configured to continuously calculate a smoothing spectrum estimate from the continuous stream of noise. The noise removal module 124 is coupled to the smoothing spectrum module and is configured to remove noise from a selected one of the plurality of input signals using the smoothing spectrum estimate. The noise removal module 124 removes noise from the selected one of the plurality of input signals substantially synchronously and in time alignment with the noise creation module creating the continuous stream of noise.

In some aspects, the smoothing factor creation module 122 is configured to calculate the smoothing spectrum estimate by determining a difference in spectral deviation between a long term noise estimate and a short term noise estimate. In other aspects, the application of the smoothing spectrum estimate is effective to suppress noise in the microphone signal. In some other aspects, the plurality of input signals comprises a first signal from a primary microphone and a second signal from a secondary microphone. In yet other aspects, the noise creation module 120 is configured to create the continuous stream of noise by cancelling a speech component from the secondary microphone signal using the first signal as a reference to leave a continuous noise signal.

Figure 2:
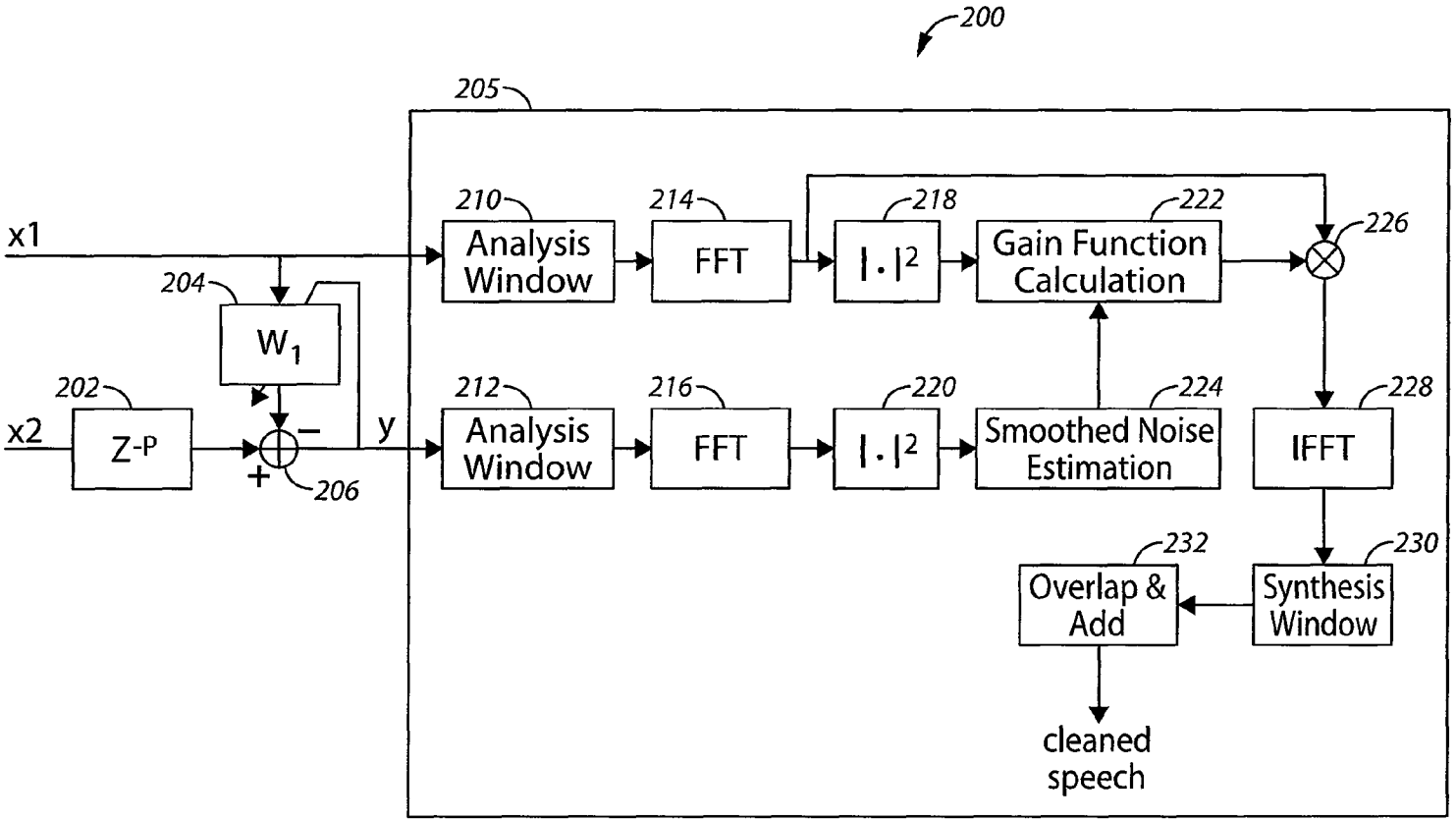
FIG. 2 comprises a block diagram of a noise suppression system according to various embodiments of the present invention.

Referring now to FIG. 2, one example of a circuit 200 that cancels/suppresses noise is described. A primary microphone produces a signal x1 and a secondary microphone produces a signal x2. The signal x2 is applied to a block 202. An adaptive filter 204 and summer 206 cancel the speech component of x2. Thus, a continuous noise stream y is extracted from the secondary microphone (represented by the signal $x_2$). As the speech component at $x_2$ is cancelled through the use of an adaptive filter 204 ($W_1$)(with the signal $x_1$ at primary microphone being a reference) only noise remains. This processing by the adaptive filter 204 is based in one example on the normalized linear mean square (NLMS) algorithm.

As illustrated in FIG. 2, the signal x1 from the primary microphone, along with the continuous noise stream signal y are sent to a single channel noise suppressor 205. Unlike some previous single channel noise suppressors, a smoothed noise spectrum is directly estimated from the independent noise stream, instead of using a voice activity detection (VAD) based, on-and-off noise estimate. The single channel noise suppression algorithm calculates a smoothed noise spectrum from this noise source to attenuate noise on the primary microphone. Because of the nature of this continuous noise supply, the noise spectrum estimate is synchronous with the noise suppression process. By "synchronous" and as used herein, it is meant that there is no significant or substantial delay. Unlike previous approaches having a fixed smoothing factor in noise estimate, the present approaches use noise estimate that is made dynamic through the use a variable smoothing factor, which is calculated based on a spectral deviation measured between a long term noise and a short term noise. This noise estimate enables a more accurate and dynamic noise suppression than the algorithms based on the traditional VAD based noise estimate.

More specifically and as shown in FIG. 2, the single channel noise suppressor 206 includes a first analysis window element 210, a second analysis window element 212, a first fast Fourier transform element 214, a second fast Fourier transform element 216, a first squaring element 218, a second squaring element 220, a gain function module 222, a smoothed noise estimation module 224, a summer 226, an inverse fast Fourier transform module 228, a synthesis window element 230, and an overlap and add module 232.

The functions of the first analysis window element 210 and the second analysis window element 212 are to provide window analysis function. The first fast Fourier transform element 214 and the second fast Fourier transform element 216 obtain a Fourier transform of the signal. The first squaring element 218 and the second squaring element 220 provide a squaring function. The function of the gain function module 222 is to provide a gain function. The function of the smoothed noise estimation module 224 is to provide a smoothed noise estimate. The summer 226 sums the output of the gain function module 222 and the output of the first squaring element 218. The inverse fast Fourier transform module 228 obtains an inverse Fourier transform of its input. The function of the synthesis window element 230 is to provide synthesis functions for application to the signal. The overlap and add module 232 provides overlap and addition functions for application to the signal.

Figure 3:
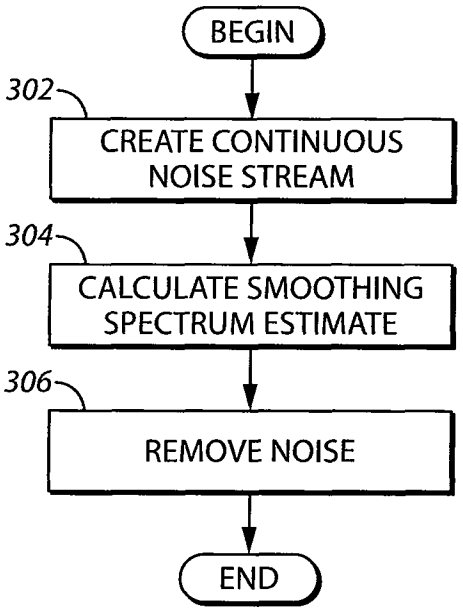
FIG. 3 comprises a flowchart of a noise suppression approach according to various embodiments of the present invention.

In one example, the desired speech is captured along with background speech (e.g., babble noise) via two microphones and these two microphones are displaced a predetermined distance apart (e.g., 4 cm apart). Using the approaches described herein and to give one example, the SNR gain is approximately 8.5 dB, which is approximately 4.2 dB higher than some previous single channel noise suppression algorithms. The use of a separate and reliable noise source in a single channel based noise suppression of the present approaches cancels non-stationary (as well as stationary) noise effectively during speech presence, and is immune to the errors made by VAD inside main stream single NS algorithms Referring now to FIG. 3, one example of a noise suppression approach is described. At step 302, a continuous stream of noise is created from a plurality of input signals. In one example, inputs are received from two microphone signals and the microphones are deployed in a vehicle.

At step 304, a smoothing spectrum estimate is continuously calculated from the continuous stream of noise. In one aspect, the smoothing spectrum estimate is determined by calculating a spectral deviation between a long term noise estimate and a short term noise estimate. Other examples are possible.

At step 306, noise is responsively removed from a selected one of the plurality of input signals using the smoothing spectrum estimate. The removal of the noise from the selected input signal is performed substantially synchronously and in time alignment with the creating of the continuous stream of noise and the calculating of the smoothing spectrum estimate. By substantially synchronously and in time alignment it is meant that there is no significant or substantial delay between these two events.

Figure 4:
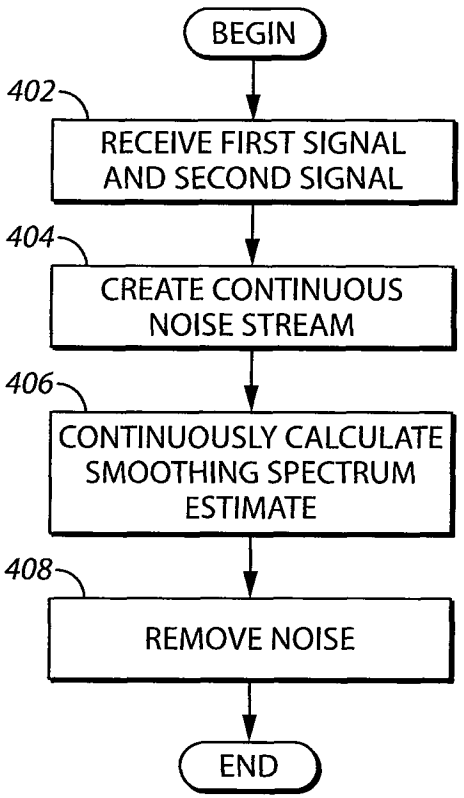
FIG. 4 comprises a flowchart of a noise suppression approach according to various embodiments of the present invention.

Referring now to FIG. 4, another example of a noise suppression approach is described. At step 402, a first signal and a second signal are received. The first signal and second signals may be received, for example, from microphones deployed in a vehicle. It will be appreciated that the microphones can be deployed at other locations as well.

At step 404, a continuous stream of noise is created based upon the first signal and the second signal. In one aspect, creating the continuous stream of noise may include cancelling a speech component from the first microphone signal.

At step 406, a smoothing spectrum estimate is continuously calculated using the continuous stream of noise. In one aspect, the smoothing spectrum estimate is determined by calculating a spectral deviation between a long term noise estimate and a short term noise estimate.

At step 408, noise is responsively removed from the first signal using the smoothing spectrum estimate. The removal of the noise is performed substantially synchronously and in time alignment with creating the continuous stream of noise and calculating the smoothing spectrum estimate. The noise may be removed, for example, by using an approach such as a gain function, a noise subtraction approach, or a Weiner filter. Other examples are possible.

Figure 5:
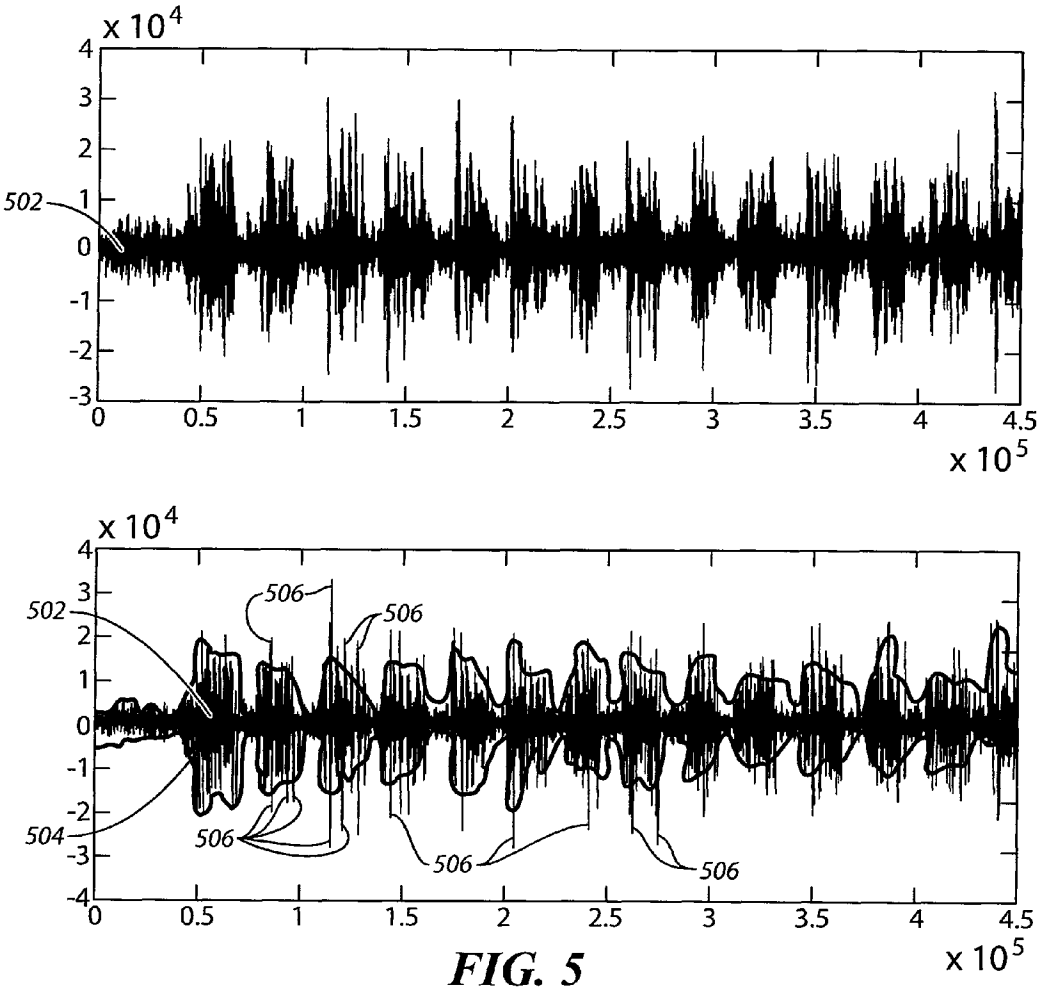
FIG. 5 comprises a graph showing noise reduction results of the approaches described herein.

Referring now to FIG. 5, one example of the results of applying the present approaches to a noise signal 502 at a primary microphone is described. Using the present approaches an output signal within the envelop 504 is created. However, it can be seen that with previous approaches more noise (generally indicted by noise peaks 506) is output. Consequently, it can be appreciated that the present approaches reduce noise more significantly than previous approaches.

It will be understood that the functions described herein may be implemented by computer instructions stored on a computer media (e.g., in a memory) and executed by a processing device (e.g., a microprocessor, controller, or the like).

It is understood that the implementation of other variations and modifications of the present invention and its various aspects will be apparent to those of ordinary skill in the art and that the present invention is not limited by the specific embodiments described. It is therefore contemplated to cover by the present invention any modifications, variations or equivalents that fall within the spirit and scope of the basic underlying principles disclosed and claimed herein.

What is claimed is:

1. A method comprising:

receiving a plurality of input signals at a receiver;

creating a continuous stream of noise from a plurality of input signals;

continuously calculating a smoothing spectrum estimate from the continuous stream of noise, wherein calculating the smoothing spectrum estimate comprises calculating a difference in spectral deviation between a long term noise estimate and a short term noise estimate;

removing noise from a selected one of the plurality of input signals using the smoothing spectrum estimate to create an output signal, the removing of the noise from the selected input signal to create the output signal being performed synchronously and in time alignment with the creating of the continuous stream of noise and the calculating of the smoothing spectrum estimate.

2. The method of claim 1 wherein responsively removing the noise comprises removing the noise using an approach selected from the group consisting of: a gain function, a noise subtraction approach, and a Weiner filter.

3. The method of claim 1 wherein the plurality of input signals comprises a plurality of microphone signals.

4. The method of claim 3 wherein the plurality of microphone signals are formed from a plurality of microphones disposed at a device, the device selected from the group consisting of: a mobile phone, a hands-free vehicular application, and a hearing aid.

5. The method of claim 3 wherein the plurality of input signals comprises a first signal from a primary microphone and a second signal from a secondary microphone.

6. The method of claim 5 wherein creating a continuous stream of noise comprises cancelling a speech component from the secondary microphone signal using the first signal as a reference to leave a continuous noise signal.

7. A method of removing noise from speech, the method comprising:

receiving a first signal at a receiver;

receiving a second signal at the receiver;

creating a continuous stream of noise based upon the first signal and the second signal;

continuously calculating a smoothing spectrum estimate using the continuous stream of noise, wherein calculating the smoothing spectrum estimate comprises calculating a difference in spectral deviation between a long term noise estimate and a short term noise estimate;

removing noise from the first signal using the smoothing spectrum estimate to create an output signal, the removing of the noise to create the output signal being performed synchronously and in time alignment with creating the continuous stream of noise and calculating the smoothing spectrum estimate.

8. The method of claim 7 wherein responsively removing the noise comprises removing the noise using an approach selected from the group consisting of: a gain function, a noise subtraction approach, and a Weiner filter.

9. The method of claim 7 wherein the first signal comprises a first microphone signal and the second signal comprises a second microphone signal.

10. The method of claim 9 wherein the first microphone signal is formed at a first microphone and the second microphone signal is formed at a second microphone, and the first microphone and the second microphone are disposed at a device, the device selected from the group consisting of: a mobile phone, a hands-free vehicular application, and a hearing aid.

11. The method of claim 9 wherein creating a continuous stream of noise comprises cancelling a speech component from the first microphone signal.

12. A system comprising:

a receiver that is configured to receive a plurality of input signals at an input;

a noise creation module configured to create a continuous stream of noise from the plurality of input signals;

a smoothing spectrum creation module coupled to the noise creation module, the smoothing spectrum creation module configured to continuously calculate a smoothing spectrum estimate from the continuous stream of noise, wherein calculating the smoothing spectrum estimate comprises calculating a difference in spectral deviation between a long term noise estimate and a short term noise estimate;

a noise removal module coupled to the smoothing spectrum module, the noise removal module being configured to remove noise from a selected one of the plurality of input signals using the smoothing spectrum estimate to create an output signal;

such that the noise removal module removes noise from the selected one of the plurality of input signals substantially synchronously and in time alignment with the noise creation module creating the continuous stream of noise estimate to create the output signal;

a transmitter that is configured to transmit the output signal.

13. The system of claim 12 wherein the smoothing factor creation module is configured to calculate the smoothing spectrum estimate by determining a difference in spectral deviation between a long term noise estimate and a short term noise estimate.

14. The system of claim 12 wherein the application of the smoothing spectrum estimate is effective to suppress noise in the microphone signal.

15. The system of claim 14 wherein the plurality of input signals comprises a first signal from a primary microphone and a second signal from a secondary microphone.

16. The system of claim 15 wherein the noise creation module is configured to create the continuous stream of noise by cancelling a speech component from the secondary microphone signal using the first signal as a reference to leave a continuous noise signal.

* * * * *